US006263640B1

(12) United States Patent
Handel

(10) Patent No.: US 6,263,640 B1
(45) Date of Patent: Jul. 24, 2001

(54) BACON BOARD DISPENSER

(75) Inventor: Gary A. Handel, Austin, MN (US)

(73) Assignee: Hormel Foods, LLC, Austin, MN (US)

( * ) Notice: Subject to any disclaimer, the term of this patent is extended or adjusted under 35 U.S.C. 154(b) by 0 days.

(21) Appl. No.: 09/352,643

(22) Filed: Jul. 13, 1999

(51) Int. Cl.[7] ..... B65B 25/08

(52) U.S. Cl. ..... 53/156; 53/157; 53/534; 53/389.1

(58) Field of Search ..... 53/157, 389.1, 53/517, 534, 156; 493/478

(56) References Cited

U.S. PATENT DOCUMENTS

| | | | | |
|---|---|---|---|---|
| 4,265,073 | * | 5/1981 | Seragnoli | 53/542 |
| 4,328,657 | | 5/1982 | Brandmaier et al. | 53/586 |
| 4,452,031 | | 6/1984 | Dennis et al. | 53/586 |
| 4,524,558 | * | 6/1985 | Miles | 53/157 |
| 4,633,651 | * | 1/1987 | Edmunds | 53/534 |
| 4,793,117 | * | 12/1988 | Raudat et al. | 53/534 |
| 5,117,717 | * | 6/1992 | Mally | 53/157 |
| 5,678,385 | * | 10/1997 | Focke et al. | 53/234 |
| 5,761,882 | * | 6/1998 | Gambetti | 53/157 |

FOREIGN PATENT DOCUMENTS

| | | |
|---|---|---|
| 0 677 442 | 10/1995 | (EP) . |
| 0 608 823 | 12/1996 | (EP) . |
| 384 606 | 12/1932 | (GB) . |

* cited by examiner

*Primary Examiner*—John Sipos
(74) *Attorney, Agent, or Firm*—Mau & Krull, P.A.

(57) ABSTRACT

A bacon board dispenser (10) deposits predetermined quantities of sliced bacon in a shingled condition on bacon boards. The dispenser (10) includes a frame having a support side (12) and an operating side (11). The output conveyor (172), bacon board dispenser mechanism (193), and feeding mechanism (146) are cantilevered from the support side of the frame to provide for an open operating side for ease of bacon board loading, cleaning and maintenance. The dispenser (10) includes a multi-positioned bacon board magazine (43). The dispenser mechanism utilizes two sets of vacuum cups (210, 211) to provide for an easy changeover between different size boards.

4 Claims, 14 Drawing Sheets

BACON BOARD DISPENSER

BACKGROUND OF THE INVENTION

1. Field of the Invention

This invention relates generally to bacon board dispensers, and more particularly to a cantilevered design for a bacon board dispenser utilizing an easily adjustable board magazine having variable pressure and a dispenser having dual vacuum cups.

2. Description of the Prior Art

Bacon board dispensers are commercially available and in use for conveying and depositing sliced bacon in shingled conditions in predetermined quantities (e.g., ½ pound, 1 pound, 2 pounds) onto so-called bacon boards for further packaging and insertion in a folded outer carton or other enclosures in evacuated and hermetically sealed envelopes of suitable film. Also, machines are available to package bacon on bacon boards or cards which are relatively thin and quite flexible and have a cutout window area for viewing the product.

Due to the designs of such machines, they typically can package only 55 boards per minute because of their excess motion. Further, the bacon boards are of various size for the different quantities of bacon to be packaged. Adjustments are therefore necessary for the size of the bacon boards. This involves a setup which is typically quite consuming in converting the machinery from one size board to the other board. In addition, the dispensing of the boards is often dependent upon the size of the stack of bacon boards to be dispensed. Applicant is unaware of board magazines which compensate for the varying loads created by the varying amounts of bacon boards as they are dispensed.

Sanitation requirements are also quite stringent for the packaging of bacon. In order to comply with the sanitation requirements, cleaning of the machines are necessary. Also, repairs are often necessary to the machines. The closed design of the prior art does not provide for ease of cleaning and maintenance.

SUMMARY OF THE INVENTION

The invention is an apparatus for depositing predetermined quantities of sliced bacon in shingled condition on bacon boards. The apparatus includes a frame having an input end, output end, support side, and operating side. An infeed conveyor is operatively connected to a frame and a cantilevered output conveyor is operatively connected to the support side and extends towards the operating side. A bacon board dispenser mechanism is cantilevered and operatively connected to the support side and extends to the operating side. A bacon board magazine is positioned proximate the dispenser mechanism for supplying bacon boards to the dispenser mechanism. A cantilevered feeding mechanism is operatively connected to the support side and extends to the operating side. The feeding mechanism is for taking a bacon board dispensed by the dispenser mechanism and placing the bacon board under the sliced bacon, wherein the operating side is open thereby easing bacon board loading, cleaning and maintaining the apparatus.

In another embodiment, the invention is an apparatus for depositing predetermined quantities of sliced bacon in shingled condition on bacon boards. The apparatus includes a frame having an input end, output end, support side and operating side. An infeed conveyor and output conveyor are operatively connected to the frame. A dispenser mechanism and feeding mechanism is also operatively connected to the frame. A multi-positioned bacon board magazine includes a generally vertical bearing member. A first frame is mounted for vertical movement on the bearing member. The frame has a carrying surface for holding the bacon boards. A lift is operatively connected to the first frame for moving the first frame vertically. A cradle is operatively connected to the bearing member, and the cradle has a plurality of stops at different vertical heights. The cradle is slidable laterally to position a selected stop under the frame, wherein the frame is lowered to contact the selected stop, thereby positioning the frame.

In another embodiment, the invention is an apparatus for depositing quantities of sliced bacon in shingled condition on bacon boards. The apparatus includes a frame having an input end, output end, support side and operating side. An infeed conveyor and output conveyor are operatively connected to the frame. A dispenser mechanism and feeding mechanism are also operatively connected to the frame. A bacon board magazine has a support surface for holding the bacon boards and a pushing member for pushing the bacon boards towards the dispensing mechanism and feeding mechanism. Means for applying pressure to the pushing member and means for sensing an amount of bacon boards on the support surface and lowering pressure applying to the pushing member as the amount of bacon boards decrease are provided.

In another embodiment, the invention is an apparatus for depositing predetermined quantities of sliced bacon in shingled condition on bacon boards. The apparatus includes a frame having an input end, output end, support side and operating side. An infeed conveyor and output conveyor are operatively connected to the frame. A bacon board magazine has a support surface for holding the bacon boards. A dispenser mechanism is operatively connected to the frame. The dispenser mechanism includes a first vacuum member for grasping a bacon board from the bacon board magazine. The first vacuum member is operatively connected to the dispenser mechanism for movement between a first grasping position and a second releasing position. A second vacuum member is provided for grasping a bacon board from the bacon board magazine. The second vacuum member is operatively connected to the dispenser mechanism for movement between the first and second positions, the second vacuum member spaced from the first vacuum member. A valve is used to selectively supply a vacuum to the first and second vacuum members, wherein bacon boards of different configurations may easily be dispensed. A feeding mechanism is operatively connected to the frame. The feeding mechanism takes the bacon boards dispensed by dispenser mechanism and places the bacon boards under the sliced bacon.

DETAILED DESCRIPTION OF THE PREFERRED EMBODIMENT

Figure 1:
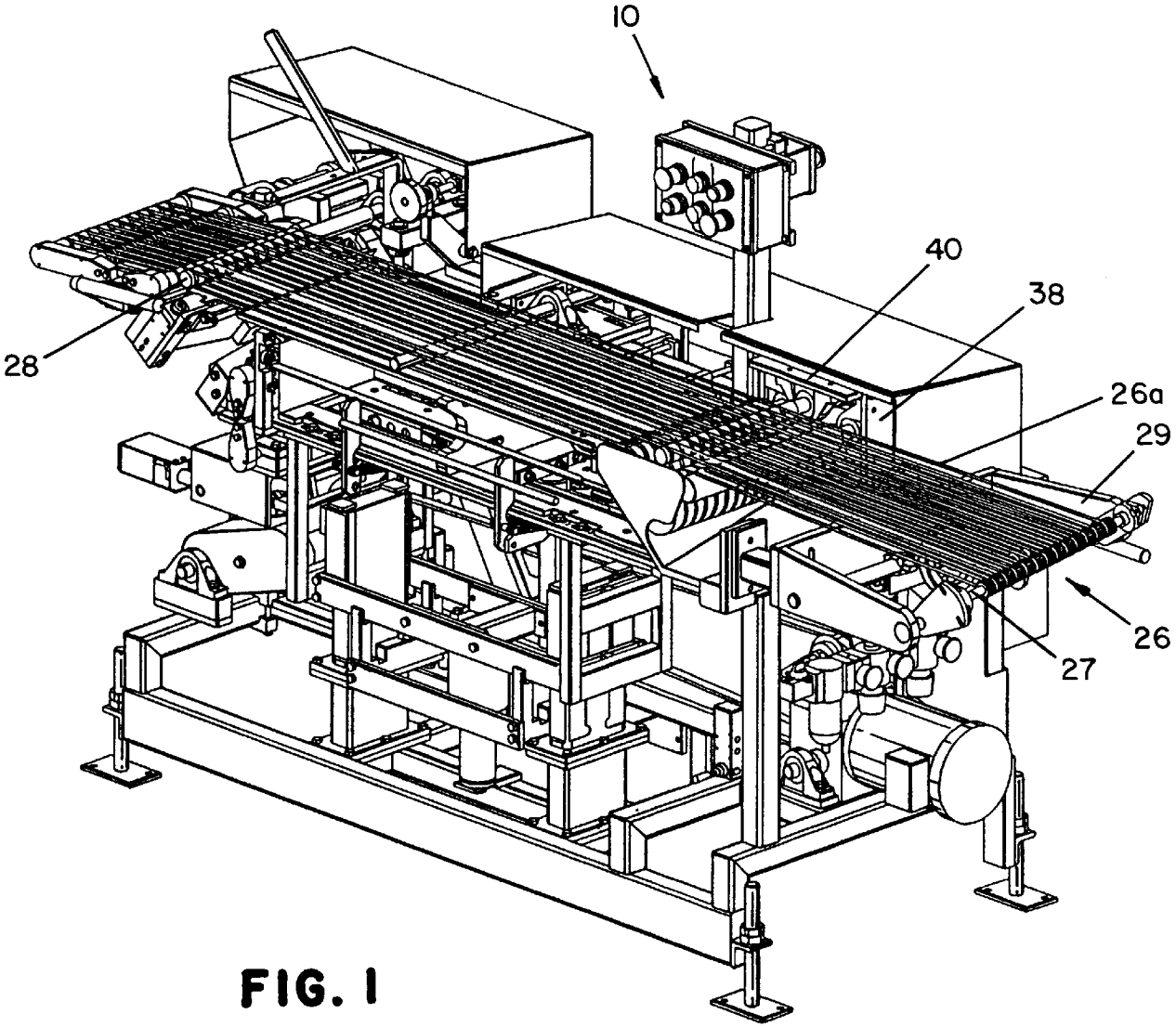
FIG. 1 is a perspective view of the present invention.
Figure 2:
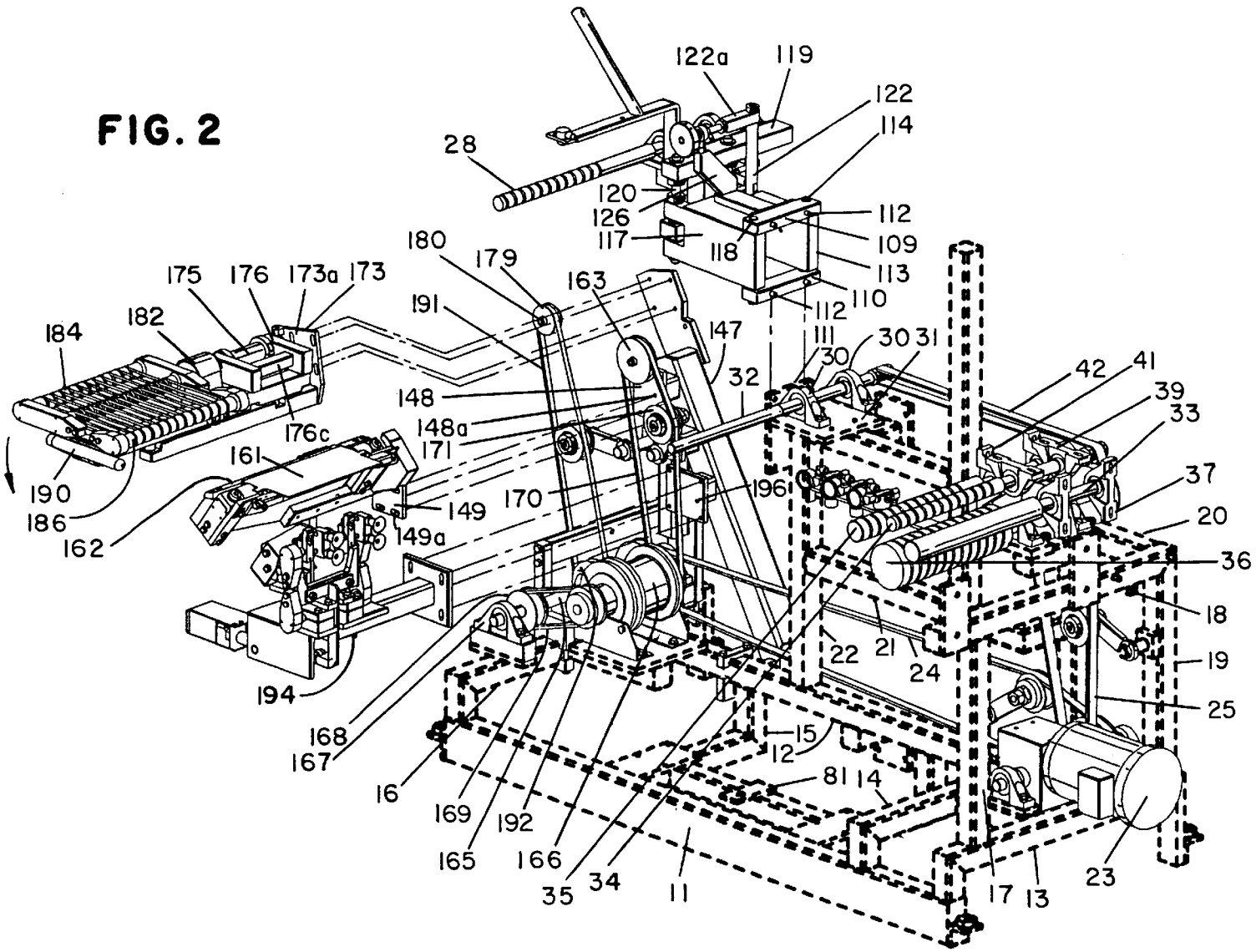
FIG. 2 is an exploded perspective view of cantilevered members shown in FIG. 1.

Referring to the drawing, wherein like numerals represent like parts throughout the several views, there is generally disclosed at 10 a bacon board dispenser. The dispenser 10 has a frame for supporting the various components of the dispenser. FIG. 2 shows the dispenser with various components exploded away. Further, the frame is shown in dashed lines. The frame includes an operating side base member 11 connected to a support side base member 12 by a plurality of cross members 13 through 16. Cross member 13 is at the input end of the dispenser 10 and cross member 16 is at the output end of the dispenser 10. Members 17, 18 and 19 are operatively connected to form the input end of the frame. A support side frame comprises horizontal members 20 and 21 operatively connected to upright member 22. The members 11 through 22 are connected by suitable means such as welding. It is of course understood that other suitable constructions of a frame may be utilized. However, as will be discussed more fully hereafter, it is noted that there is not an operating side frame which would effect access to the operating side of the dispenser 10.

A drive assembly 23 is mounted to the frame between cross members 13 and 14. The output of the drive assembly 23 is operatively connected to two drive belts 24 and 25. Drive belt 24 is utilized to drive the components at the output end of the dispenser 10. These will be described in more detail hereafter. The drive belt 25 is utilized to drive the infeed conveyor, generally designated at 26.

The infeed conveyor 26 has a plurality of O-rings 26*a* which rotate around an input end shaft 27 and an output end shaft 28. A U-shaped connector 29 is secured at one end to the frame. At the other end of the U-shaped connector 29, the input end shaft 27 is mounted in suitable bearings to allow it to rotate. Two bearing blocks 30 are bolted to a plate 31 which is in turn bolted to horizontal member 20. A driven shaft 32 is mounted in the bearing blocks 30 for rotation. The driven shaft 32 is cantilevered from the support side of the dispenser 10. Shafts 33 through 36 are also cantilevered from the operating side of the dispenser 10. Two bearing blocks 37 are bolted to a plate 38. Two bearing blocks 39 are bolted to a plate 40. Two bearing blocks 41 are bolted to another plate (not shown). Finally, two additional bearing blocks (not shown) are bolted to a plate (not shown) to support the shaft 36. The plates 38 and 40 and the two plates not shown are bolted together to form a box which is in turn bolted and connected to the frame on the support side of the dispenser 10. Shaft 33 is rotatably mounted in the bearing blocks 37. Shaft 34 is rotatably mounted in the bearing blocks 39 and shaft 35 is rotatably mounted in the bearing blocks 41. The shaft 36, as previously mentioned, is similarly supported by bearing blocks and a plate. It is understood that other suitable structures to support the shafts 33 through 36 in a cantilevered fashion may be utilized. Shafts 27, 28, 34, 35 and 36 have grooves in which the O-rings 26*a* are positioned.

The shafts of the infeed conveyor 26 are suitably driven by the drive belt 25. One suitable arrangement would be for the drive belt 25 to drive a sprocket gear positioned between the shafts 34, 35 and 36. The sprocket gear in turn would drive the shafts 34, 35 and 36. Shaft 34 has an extension on which a belt 42 is positioned. The belt 42 rotates as the shaft 34 is driven. The belt 42 also rotates around an extension of shaft 32, thereby driving shaft 32.

Figure 3:
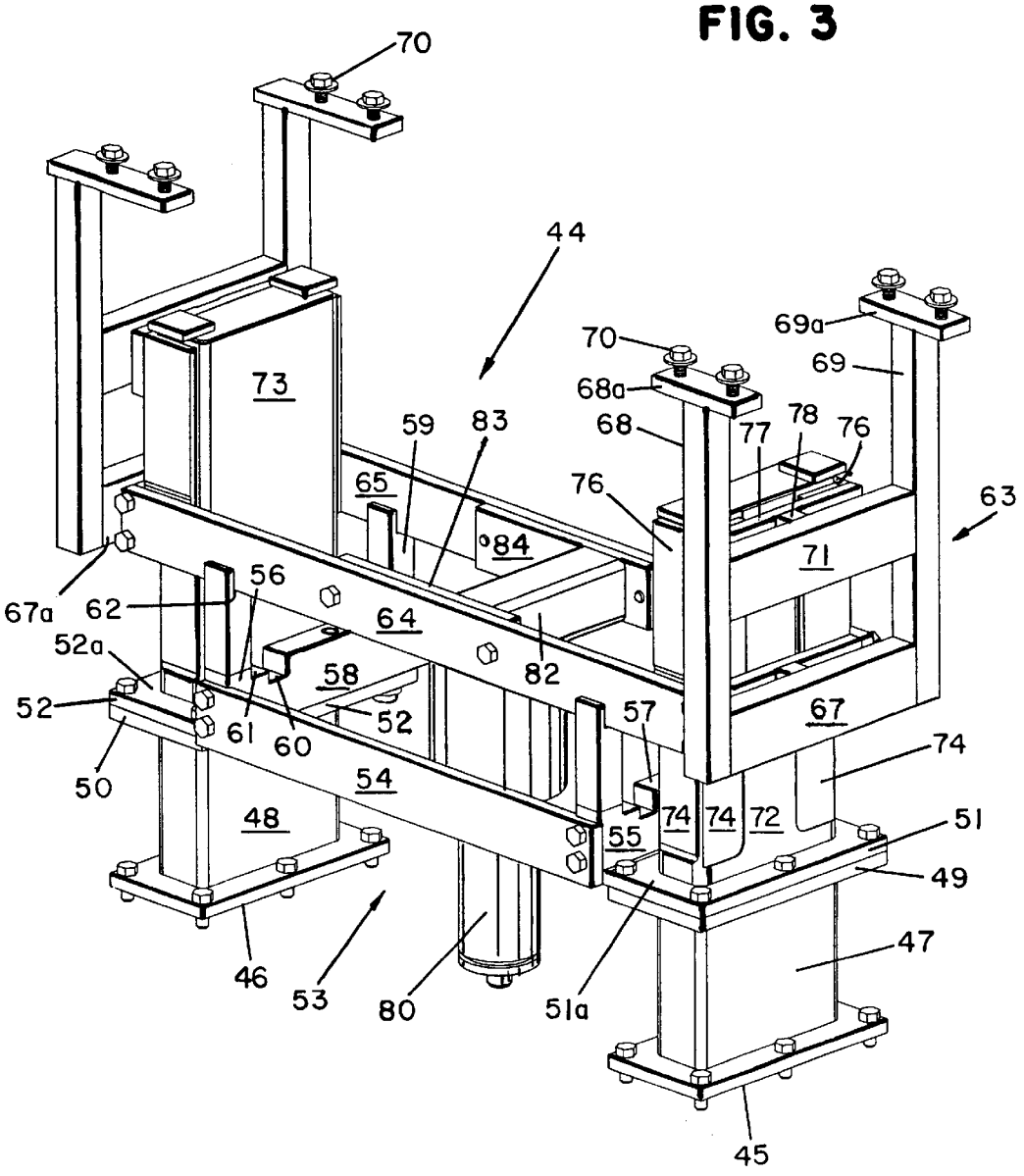
FIG. 3 is a perspective view of the magazine cradle shown in FIG. 1.
Figure 4:
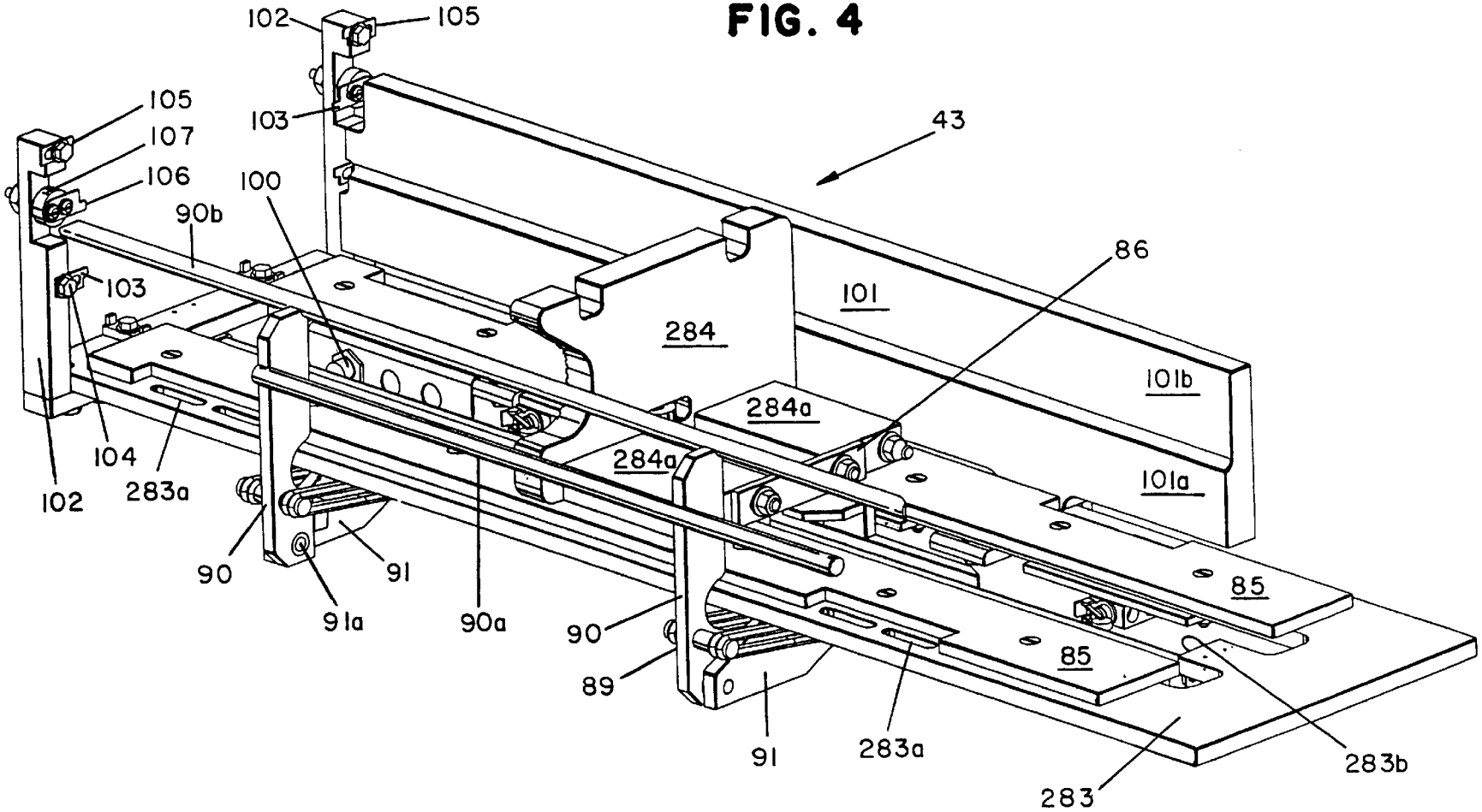
FIG. 4 is a perspective view of the board magazine shown in FIG. 1.
Figure 5:
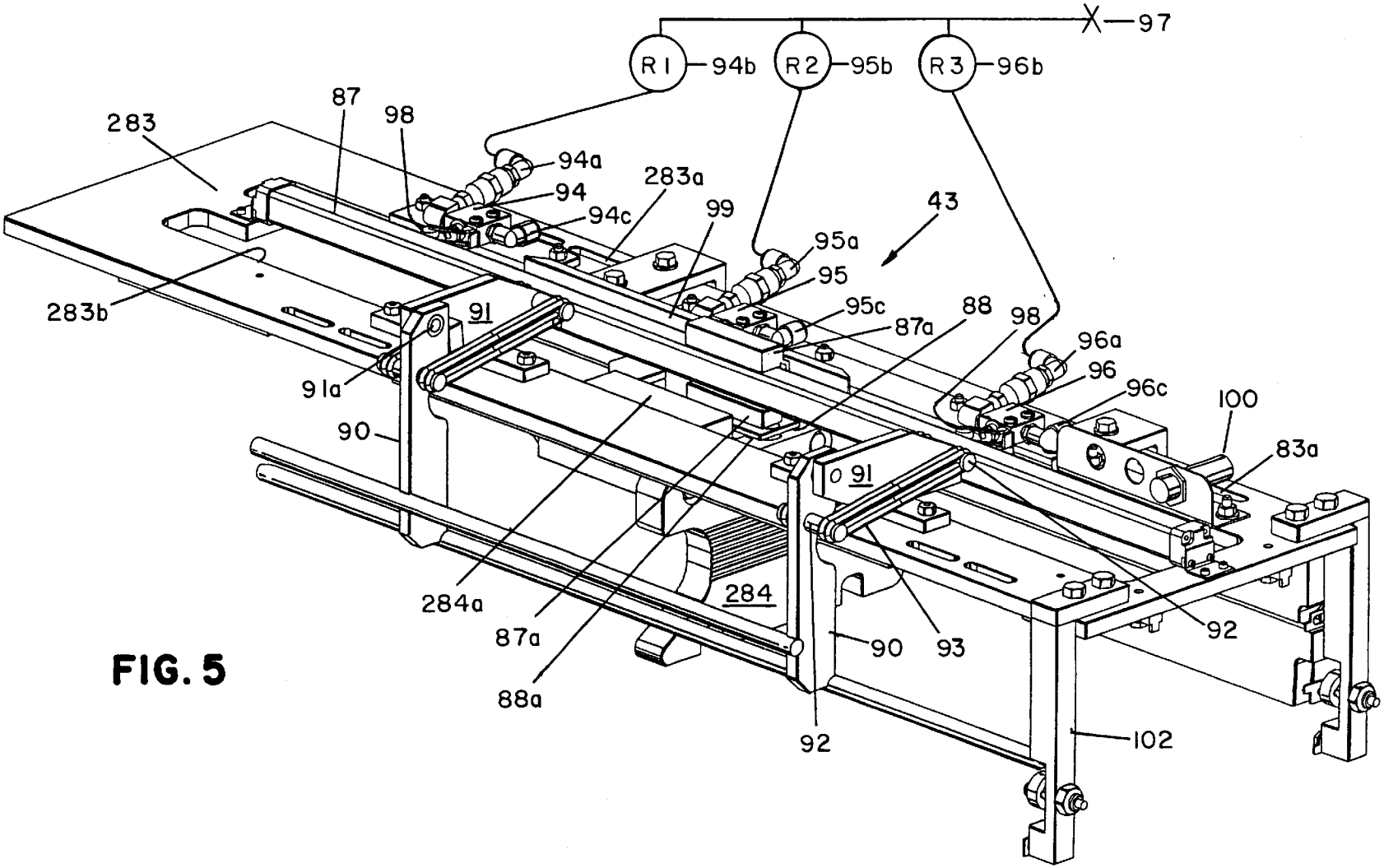
FIG. 5 is a perspective view of the board magazine shown in FIG. 4 from below.

A board magazine generally designated at 43 is shown in FIGS. 4 and 5. The board magazine 43 is carried on an adjustable cradle, generally designated at 44 and shown in FIG. 3. The cradle 44 includes base plates 45 and 46 which are bolted to the frame cross members 14 and 15 respectively. Standoffs 47 and 48 are connected to the base plates 45 and 46 by suitable means such as welding. Top plates 49 and 50 are secured to the standoffs 47 and 48, again by suitable means such as welding. Bearing plates 51 and 52 are bolted to the top plates 49 and 50. The bearing plates 51 and 52 have a top surface 51*a* and 52*a*. A horizontally slidable support stop is generally designated at 53. The support stop 53 slides horizontally on top of the top surfaces 51*a* and 52*a*. The support stop 53 includes a cross member 54 which at one end is bolted to a multi-positioned stop member 55 at one end and another multi-positioned stop member 56 at its other end. Connected to the stop member 56 by an intermediate section 58 is another multi-positioned stop member 59. Another multi-positioned stop member (not shown) is connected to the stop member 55 by an intermediate section 57. All four stop members are similar and therefore only one will be described in detail, it being understood that the other stop members have similar construction. The stop member 56 is formed having three steps, thereby forming three support surfaces 60, 61 and 62. Each support surface 60 through 62 is at a different elevation. The support stop 53 is moved horizontally along the top surfaces 51*a* and 52*a* by simply pulling or pushing on the cross member 54. As shown in FIG. 4, the support stop 53 is pushed in, toward the support side of the dispenser, at its maximum distance. It is movable toward the operating side in increments to position successively support surfaces 61 and 62. Any suitable means to slidably connect the support stop 53 to the plates 51 and 52 may be utilized. For instance, a slot may be formed in the plates 51 and 52. Then a shoulder bolt may be threaded into the bottom of the stop members 55, 56 and 59. The shoulder bolt would then slide in the slot and maintain the sliding relationship between the support stop 53 and the plates 51 and 52 without having the support stop 53 tilt. Further, a ball detent may be located on the bottom of the stops and corresponding holes formed in the top surfaces 51*a* and 52*a*. The holes would be in alignment so that the ball detent would engage the holes when the support surfaces 60 through 62 are in the appropriate position. That is, there would be one location for locating the support surface 60 in a horizontal direction, another for support surface 61 and finally another for support surface 62.

A slidable board magazine support is generally designated at 63. The support 63 includes a rectangular base which includes cross members 64 and 65 connected by suitable means, such as welding, to side members 67 and 67*a*. In viewing FIG. 3, the construction of the magazine support is best shown toward the input end of the dispenser 10 and will therefore be described in more detail, it being understood that the construction at the output end is similar. There are two posts 68 and 69 that extend generally upward from the side members 67 and have a plate 68*a* and 69*a* which is connected by bolts 70 to the board magazine, as will be described more fully hereafter. Another cross member 71 is secured between the posts 68 and 69. Cross member 71 is suitably connected, such as by welding, to two angle members 76 via brace 77 and connector 78. The brace 77 is welded to the angle members 76 and the connector 78 is welded to the brace 77 at one end and to the cross member 71 at its other end. Rectangular guide posts 72 and 73 are secured to the bearing plates 51 and 52. Machined bearing surfaces 74 are formed on the guideposts 72 and 73 to provide for a slidable connection with the matching bearing surfaces formed on the inside of the angles 76. This allows the board magazine support 63 to slide up and down on the guide posts 72 and 73.

The slidable board magazine support is moved in a vertical direction by a suitable means such as a pneumatic Firestone Airstroke Lift Device 80. The lift device 80 is secured at its bottom end to a frame member 81 which is positioned between the cross members 14 and 15. The top end of the lift device, which provides vertical movement, is in contact with a cross bar 82 whose ends are welded to plates 83 and 84. The plates 83 and 84 are bolted to the cross members 64 and 65 respectively. Therefore, a vertical extension of the lift device 80 causes the cross bar 82 to move vertically and thereby moves the slidable board magazine support 63 in a vertical direction.

FIG. 4 is a perspective view showing the top of the board magazine 43 while FIG. 5 is a perspective view of the bottom of the board magazine 43. The board magazine 43 includes a base plate 283 which has eight elongate openings 283*a* formed therein. The openings 283*a* are formed in pairs and are for receiving the eight bolts 70 (as shown in FIG. 3) to secure the board magazine 43 to the slidable board magazine support 63. Therefore, any movement vertically of the magazine support 63 carries with it the board magazine 43. A central opening 283*b* is formed in the base plate 283. A pusher member 84 provides a motive force for pushing the boards 300 toward the output end or to the left, as shown in FIG. 4. The pusher member 284 slides on two plastic members 85 which are secured to the base plate 283 by suitable means such as screws. The base plate 283 is typically stainless steel and the boards to be dispensed do not slide well on stainless steel. Therefore, the plastic members 85 are utilized. The pusher member 284 has two block sections 284*a* attached to each side. The two block sections 284*a* are connected by a bracket 86. As can be seen in FIG. 5, the block sections 284*a* extend downward into the opening 283*b* and act as a guide to keep the pusher member 284 in alignment along the center longitudinal axis. The motive force for the pusher member 284 is supplied by an Origa rodless cylinder 87. The rodless cylinder 87 is well known and is commercially available. There is a piston inside of the rodless cylinder 87 which is acted upon by air pressure. The rodless cylinder 87 has a translating attachment 87*a* which is U-shaped and extends both above and below the rodless cylinder 87. The translating attachment 87 is bolted to a plate 88 which has a cylindrical rod 88*a* attached thereto. The cylindrical rod 89 extends into a hole which is drilled into the pusher member 284. Therefore, any movement of the translating attachment 87*a* is directly transferred to a corresponding movement of the pusher member 284.

A fence 89 has two arms 90 which have two rods 90*a* and 90*b* attached thereto. The arms 90 are connected to a bracket 91 and pivot about their point of attachment 91*a*. Standoffs 92 are attached to the arm and bracket and are connected by O-ring springs 93. The O-rings 93 provide a tension to keep the arms and bracket at a 90-degree angle. However, the O-rings stretch and allow the fence to be rotated downward, as viewed in FIG. 4, to allow for the loading of the boards. Air pressure is provided to the rodless cylinder 87 through three valves 94, 95 and 96. The valves 94 through 96 are secured to the underside of the base plate 283. The valves 94 through 96 have an inlet conduit 94*a* through 96*a* which are each operatively connected by a hose to regulators 94*b*, 95*b* and 96*b*. Each valve 94 through 96 has an outlet 94*c*, 95*c* and 96*c*. The outlets 94*c* through 96*c* are all operatively connected to the rodless cylinder 87 by a suitable connecting hose (not shown). A source of pressurized air 97 is connected to the regulators 94*b*, 95*b* and 96*b*. A typical source of pressurized air may have a pressure of approximately 100 psi. The regulators 94*b* through 96*b* may have a suitable pressure such as 55 psi for regulator 94*b*, 38 psi for regulator 95*b* and 25 psi for regulator 96*b*. This would be varied, depending on the amount of pressure that is desired to be supplied to the rodless cylinder 87. Each valve 94 through 96 has an associated spring-loaded cam follower which opens or closes the valve. The cam followers are identified as 98. The cam follower for valve 95 is hidden from view in FIG. 5 but is similar to that shown for valves 94 and 96. A shoe 99 is secured to the pushing member 84 and, as shown in FIG. 5, extends below the bottom of the base plate 283. The shoe 99 has angled ends. As will be described more fully hereafter, the shoe contacts the cam follower and opens the valve which is associated with that cam follower. When the boards fill the board magazine 43, the shoe contacts the cam follower for 94*b* providing the highest pressure. Then as the boards are used, the shoe will allow the cam follower for 94*b* to be released and contact the cam follower 98 for regulator 95*b*, thereby reducing the pressure supplied to the cylinder 87. This provides less force and this is repeated when regulator 96*b* is actuated and 95*b* is not. When the pressure supplied is reduced in steps, the higher pressure is still in the cylinder 87, and is gradually reduced as the shoe moves. It is therefore gradually reduced until it reaches the pressure of the next regulator, when the process is then repeated. If the shoe is not touching the cam follower, the valve is not operative and air will not flow out of the valve. A sensor 100 is mounted toward the output end of the dispenser 10.

Any suitable sensor 100 may be utilized. The sensor will sense the presence of the shoe 99. When the shoe 99 has traveled toward the output end, it indicates that there is a low level of boards available to be dispensed and a suitable warning light may be activated by the sensor 100. A backstop 101 is secured to the base plate 283 and provides for a stop for the boards which are loaded onto the board magazine 43. The backstop 101 has a lower section 101*a* which extends further in than the upper section 101*b*. This feature is useful when different sized boards are utilized and allows for the contact of the boards at different heights.

At the end of the board magazine 43, as shown in FIG. 4, are two uprights 102 which are secured to the base plate 283. The uprights have a lower set of stops or tabs 103 which are secured to the uprights 102 by a screw 104. The tabs 103 have slots so that the distance that the tabs 103 extend into the center of the board magazine 43 may be adjusted. Similarly, top tabs 105 are secured to the top end of the uprights 102. Middle stops or tabs 106 are mounted to a cylinder 107 which is mounted for 180-degree rotational movement on the upright 102. Therefore, the tabs may be rotated in and out of position simply rotating the cylinders 107. This is useful when different sized boards require different tabs. Tabs 106 are utilized when the smaller sized boards are run. Then, when larger boards are run, the tabs 106 are simply rotated out of the way. This provides for an easier board changeover. The tabs prevent the boards 300 from being pushed out of the board magazine 43 by the pusher 84.

Figure 6:
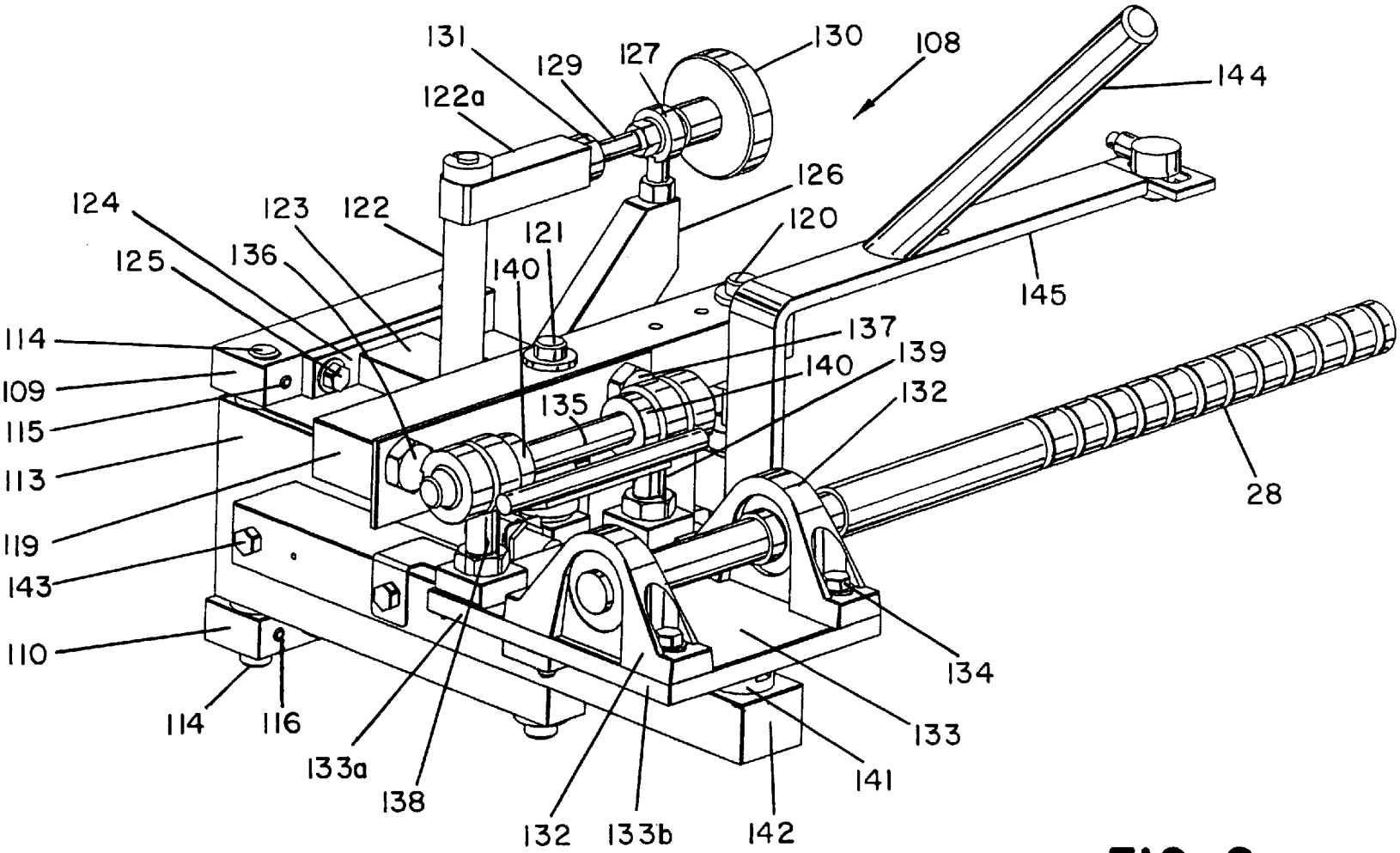
FIG. 6 is a perspective view of the output end of the conveyor shown in FIG. 1.

Referring to FIGS. 2 and 6, there is shown a steering assembly, generally designated at 108. The steering assembly 108 provides for controlling the steering of the infeed conveyor 26 by providing lateral movement of the output end shaft 28. The steering assembly 108 also provides for a cantilevered attachment of the output end shaft 28 to the support side of the bacon board dispenser. A top bar 109 and a bottom bar 110 are secured to a plate 111 by four bolts 112. The plate 111 is secured to the horizontal member 20 by suitable means such as welding. A first plate 113 is pivotally connected between the top bar 109 and the bottom bar 110 by a shaft 114. The shaft 114 is secured to the top bar 109 by means of a setscrew 115 and secured to the bottom bar 110 by means of a set screw 116. The first plate 113 is free to rotate around the shaft 114. Similarly, a second plate 117 is pivotally mounted between the top bar 109 and bottom bar 110 by means of a shaft 118. The shaft 118 is similarly secured by means of set screws (not shown) and allows the second plate 117 to rotate about the shaft 118.

The other ends of the plates 113 and 117 are rotatably connected to a bar 119. As best shown in FIG. 2, a shaft 120 is positioned in suitable bores in the second plate 117 and bar 119. Similarly, a shaft 121 rotatably mounts the plate 113 to the bar 119. This structure provides for a parallelogram to effectively move the output shaft 28. A post 122 has a first end secured by suitable means, such as welding, to the top of the first plate 113. The post 122 has a member 122*a* which extends 90 degrees from the top of the post 122. A bar 123 is welded to a cross member 124 which is in turn secured by suitable bolts 125 to the top bar 109. An extension member 126 is welded to the cross member 124 and extends upward. A nut 127 having a threaded aperture is secured to a post 128 which is in turn mounted to the top of the extension member 126. Extending through the threaded aperture of the nut 127 is a threaded rod 129 at one end of the threaded rod 129 is a knob 130 and at the other end is a nut 131. The nut 131 is threaded and is welded to member 122*a*. As the knob 130 is rotated, the threaded rod rotates in the nut 131 and moves the bar 119 to the left, as viewed in FIG. 6. As will be seen later, this allows for the movement of the output end shaft 28. Rotation of the knob 130 in the opposite direction will unscrew the threaded rod out of the nut 131 causing the bar 119 to move to the right, as viewed in FIG. 6.

The output shaft 28 is mounted in two bearing blocks 132. The bearing blocks are in turn mounted on a plate 133 by suitable bolts 134. The plate 133 has a first end 133*a* and a second end 133*b*. The plate 133 is configured to pivot at its first end 133*a* around a shaft 135. The shaft 135 is held in position by four rod ends 136 through 139. Each of the rod ends have a threaded shaft at one end and a bearing at the other. The threaded shafts for rod ends 136 and 137 are secured to the bar 119 by suitable nuts. The bearings are positioned around the shaft 135. The rod ends 138 and 139 have their threaded shafts secured to the plate 133 and their bearings positioned around the shaft 135. Clamp collars 140 are positioned around the shaft and prevent lateral movement thereof. The second end 133*b* of the plate 133 is supported on a plastic bearing or stop 141 which is in turn secured to a support bar 142. The support bar 142 is secured to the first plate 113 by suitable means such as bolts 143. The parallelogram steering structure provides for the movement to the left or right of the shaft 28. Further, the shaft 28 may be lifted upward by means of a handle 144. The handle 144 is connected to an L-bracket 145 which has one end welded to the plate 133. Therefore, when the handle 144 is moved upward, the plate 133 is rotated around the shaft 135 and the shaft 28 also rotates around the shaft 135, thereby bringing upward the output end of the infeed conveyor 26.

Figure 7:
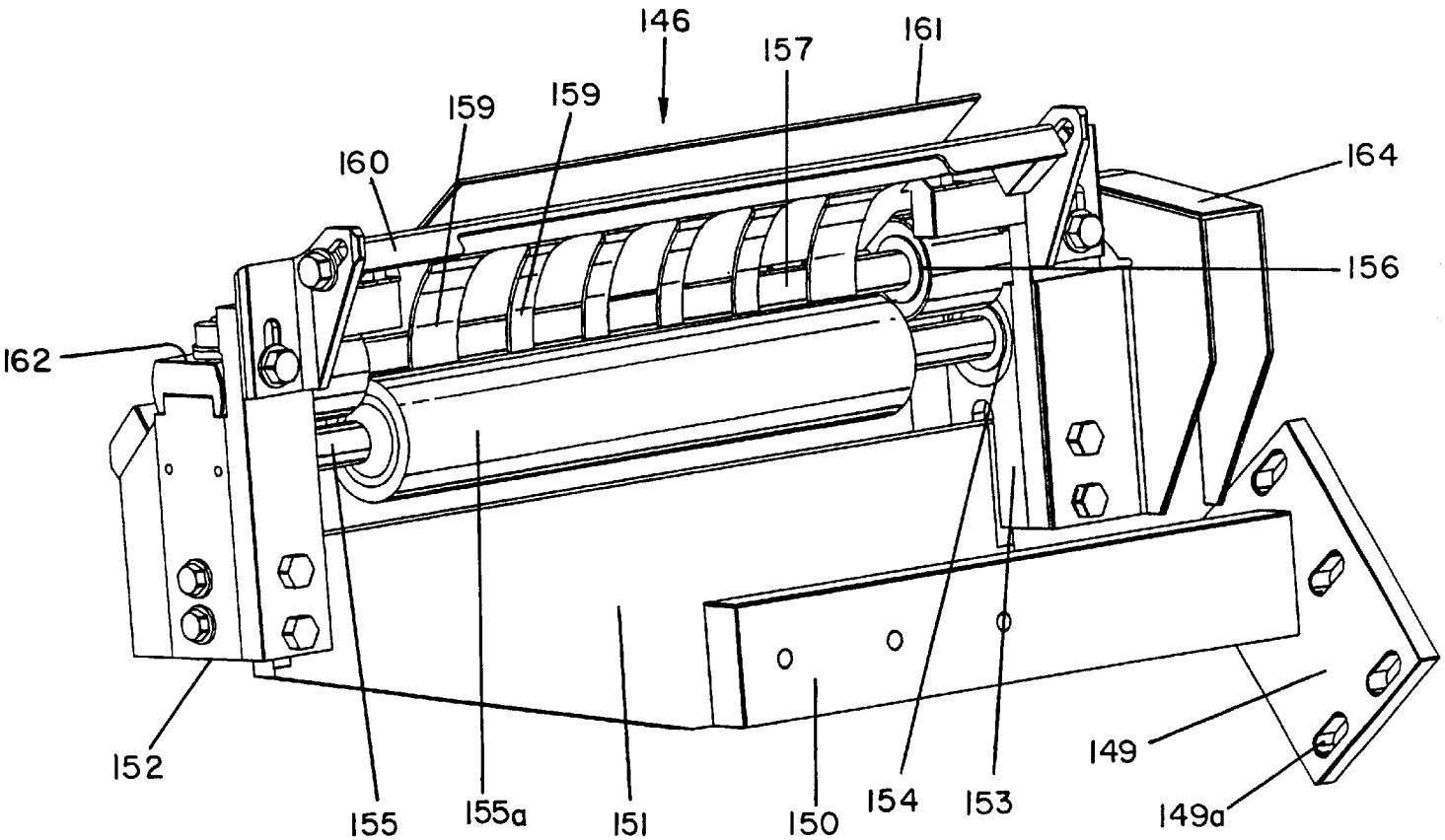
FIG. 7 is a perspective view of the pinch rollers shown in FIG. 1.
Figure 10:
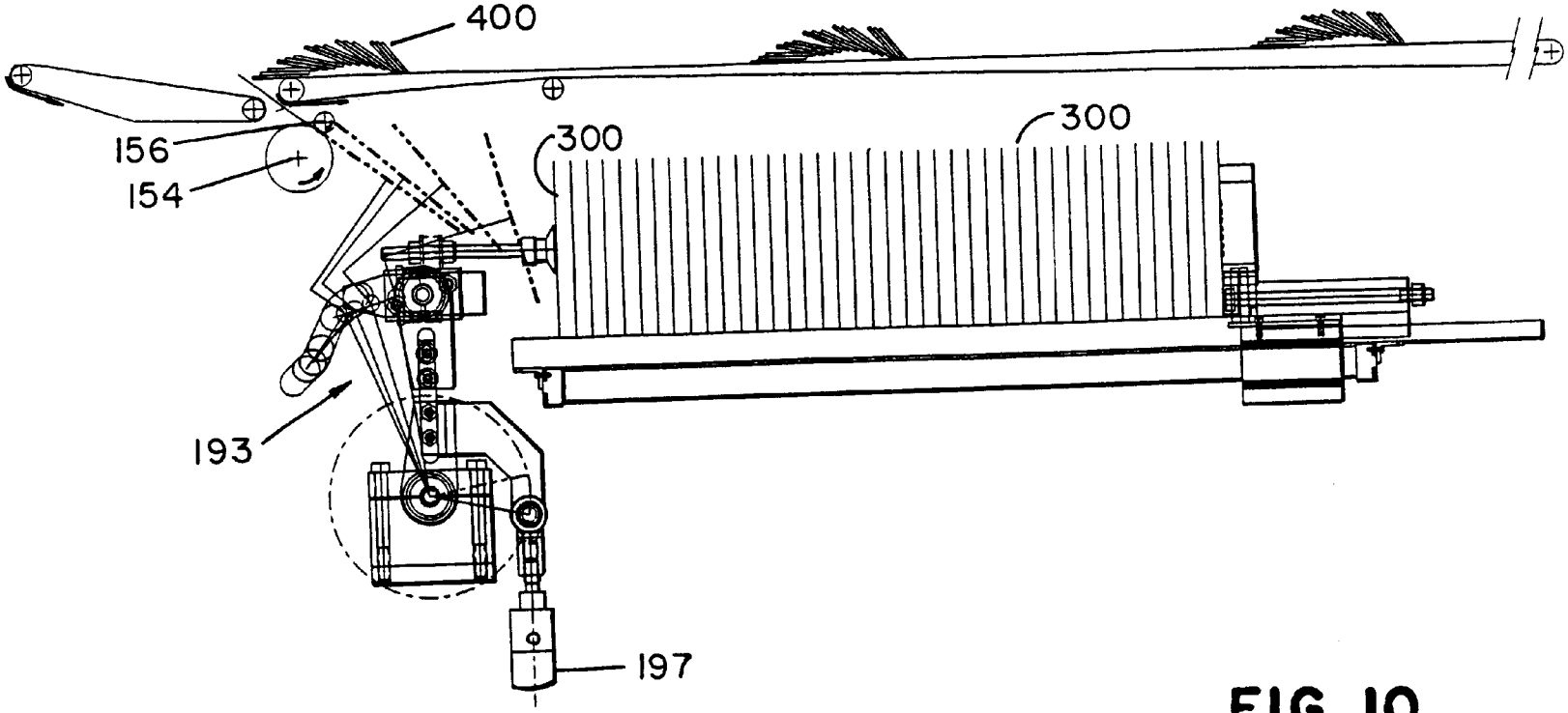
FIG. 10 is a schematic representation showing the dispensing of bacon boards according to the present invention.
Figure 11:
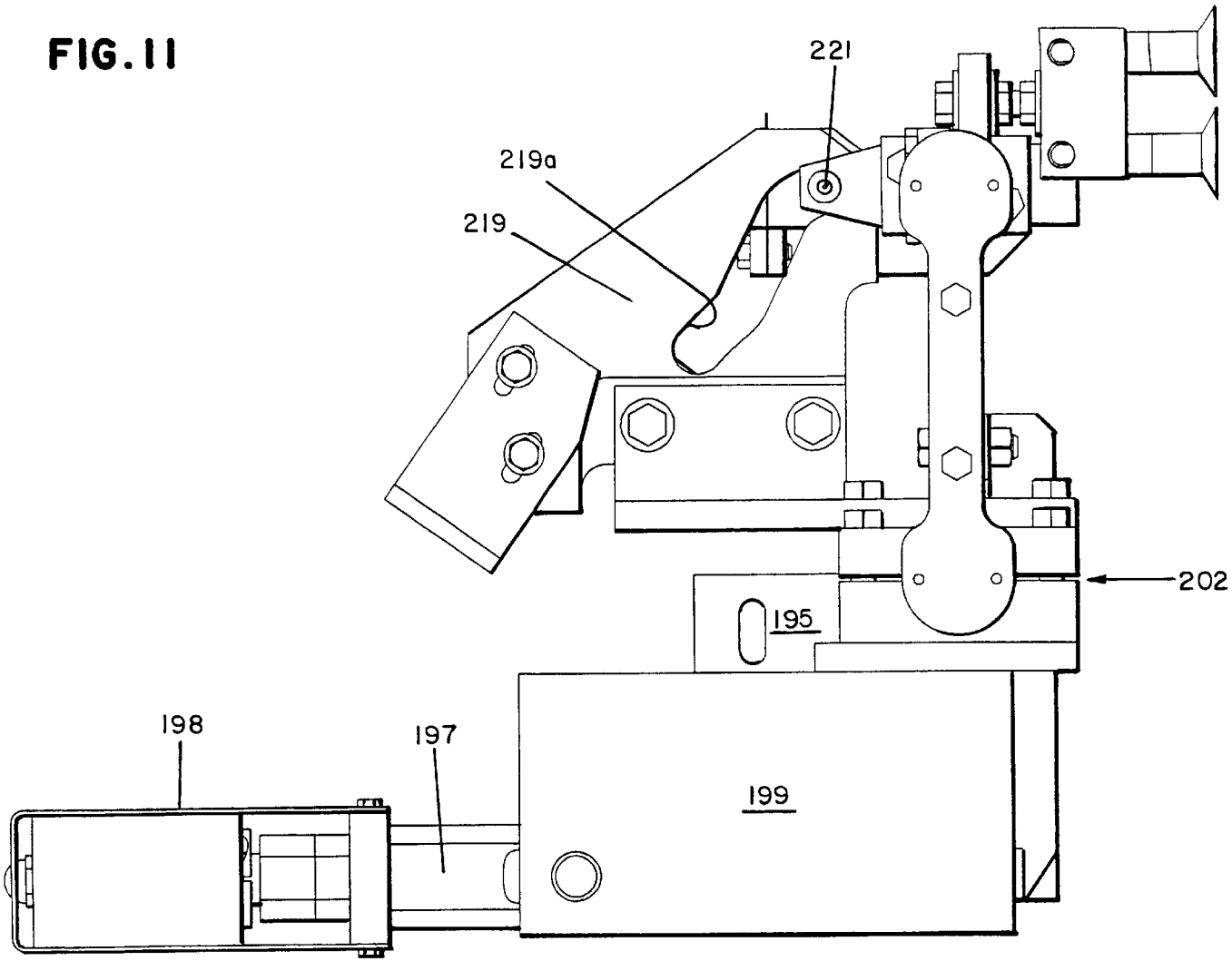
FIG. 11 is a side elevational view of the dispensing mechanism shown in FIG. 9.
Figure 12:
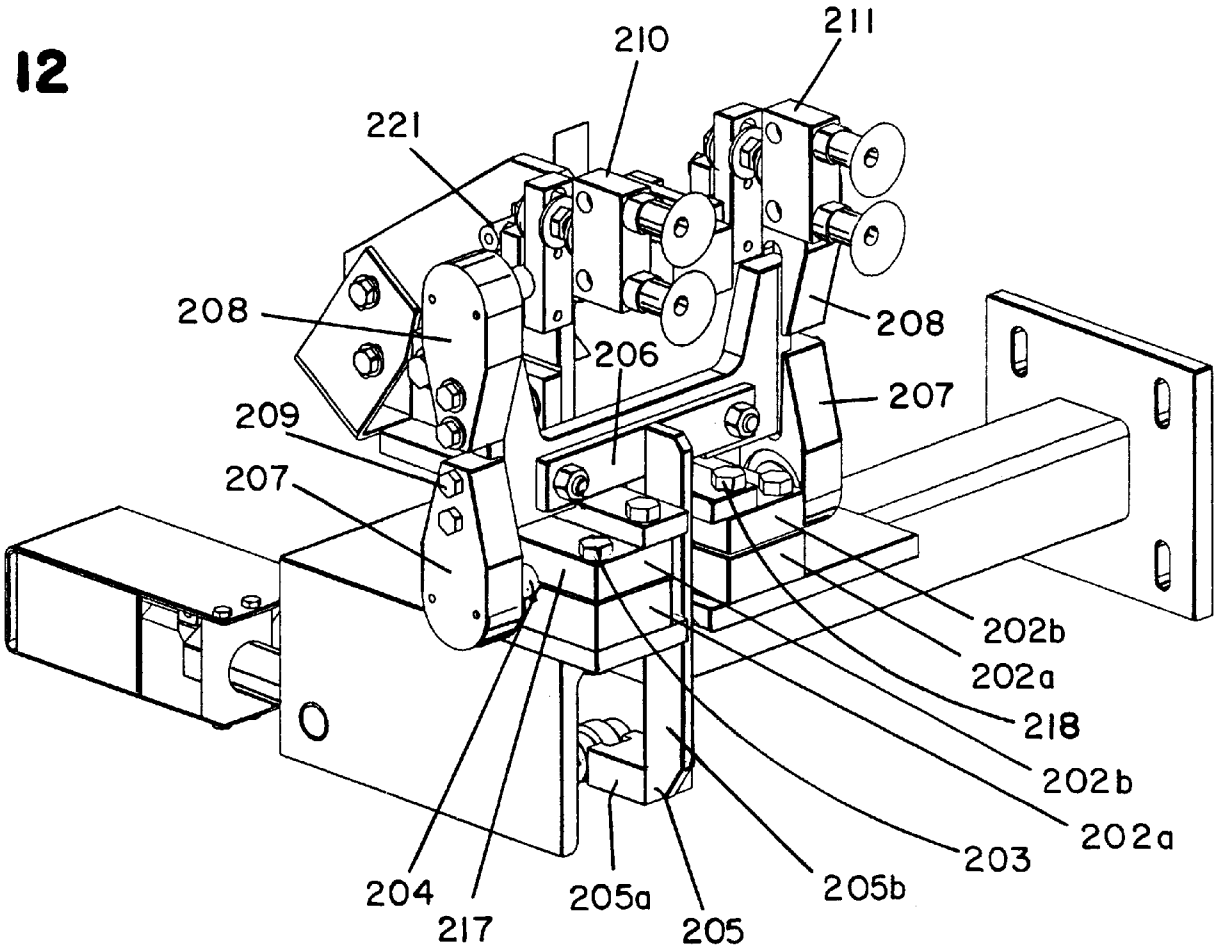
FIG. 12 is a perspective view of the vacuum cups shown in FIG. 9 rotated about 180°.

Referring to FIGS. 2 and 7, there is generally shown at 146 a feeding mechanism. The feeding mechanism 146 is cantilevered and connected to the support side of the dispenser 10 and extends toward the operating side of the dispenser 10. Referring to FIG. 2, it can be seen that an angled support 147 is secured to the side support 12 by suitable means such as welding. The angled support 147 provides a basis for providing cantilevered support to various portions of the dispenser 10. One of these is the dispenser mechanism 146. A plate 148 is secured to the angled support 147 by suitable means such as welding. The plate has a plurality of apertures 148*a* formed therein. Another plate 149 having a plurality of corresponding apertures 149*a* is secured to plate 148 by suitable means such as bolts. A support bar 150 is welded to the plate 149 and provides for cantilevered support of the dispenser mechanism 146. Secured to the support bar 150 is support member 151. Suitable means such as bolts may be used to connect the support bar 150 to the support member 151. Secured at opposite sides of the support member 151 are first and second bearing supports 152 and 153. Bearing 154 is operatively connected to the bearing support 153. Another bearing (not shown) is connected and carried by the first bearing support 152. A shaft 155 is rotatably mounted in the bearing 154. Another bearing 156 is carried by the second bearing support 153. A similar bearing (not shown) is carried by the first bearing support 152. A shaft 157 is rotatably carried by the bearing 156 and its equivalent bearing in the first bearing support 152. The bearings 154 and 156 are aligned vertically in an orientation as best seen in FIG. 10. The shaft 155 is made of an appropriate material such as steel and is covered by a soft covering 155*a*. The shaft 155 is driven. The shaft 157 is in contact with the soft covering 155*a* and is driven by friction from the rotation of the soft covering 155*a*. A plurality of smooth stainless steel fingers 159 are supported by bar 160. The fingers 159 are curved slightly and terminate just prior to the nip point between the shafts 157 and 155. The fingers 159 help guide the board being dispensed to the nip point between the shafts 155 and 157. A protective shield 161 extends over the shafts 155 and 157 to prevent bacon droppings from falling into the feeding mechanism 146. A housing 162 surrounds the back portion of the dispenser mechanism 146, as viewed in FIG. 2. Between the housing 162 and the protective shield 161 is a slit through which the bacon boards 300 are dispensed after they are driven between the shafts 155 and 157. A drive pulley 163 is positioned inside of a gear housing 164. The drive pulley 163 has the shaft 155 operatively connected to it. Therefore, rotation of the drive pulley 163 causes an equivalent rotation of the shaft 155.

The drive belt 24 drives a jack shaft 165. The jack shaft 165 has a pulley (not shown) which, as viewed in FIG. 2, is located behind the brake/clutch mechanism 166. The jack shaft 165 is mounted in a bearing block 167 at one end and a similar bearing block (not shown) at its other end. A drive pulley 168 is mounted on the drive shaft 167 and drives the brake/clutch mechanism 166 via drive belt 169. The output of the brake/clutch mechanism 166 has a drive pulley (not shown) which is connected via a drive belt 170 to the drive pulley 163. An idler pulley 171 is positioned between the pulley 163 and the brake/clutch mechanisms output.

Figure 8:
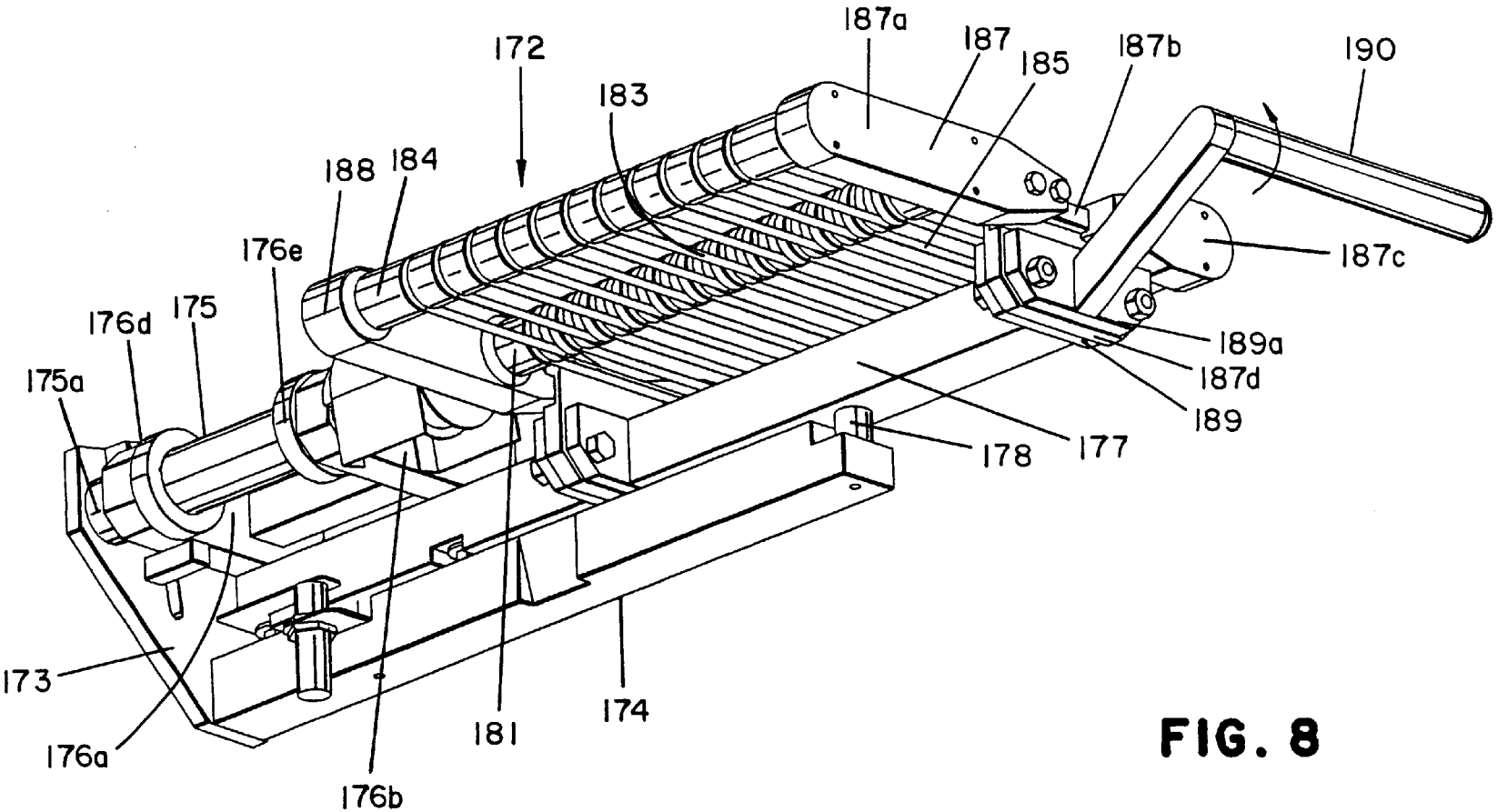
FIG. 8 is a perspective view of the output feed conveyor shown in FIG. 1.
Figure 9:
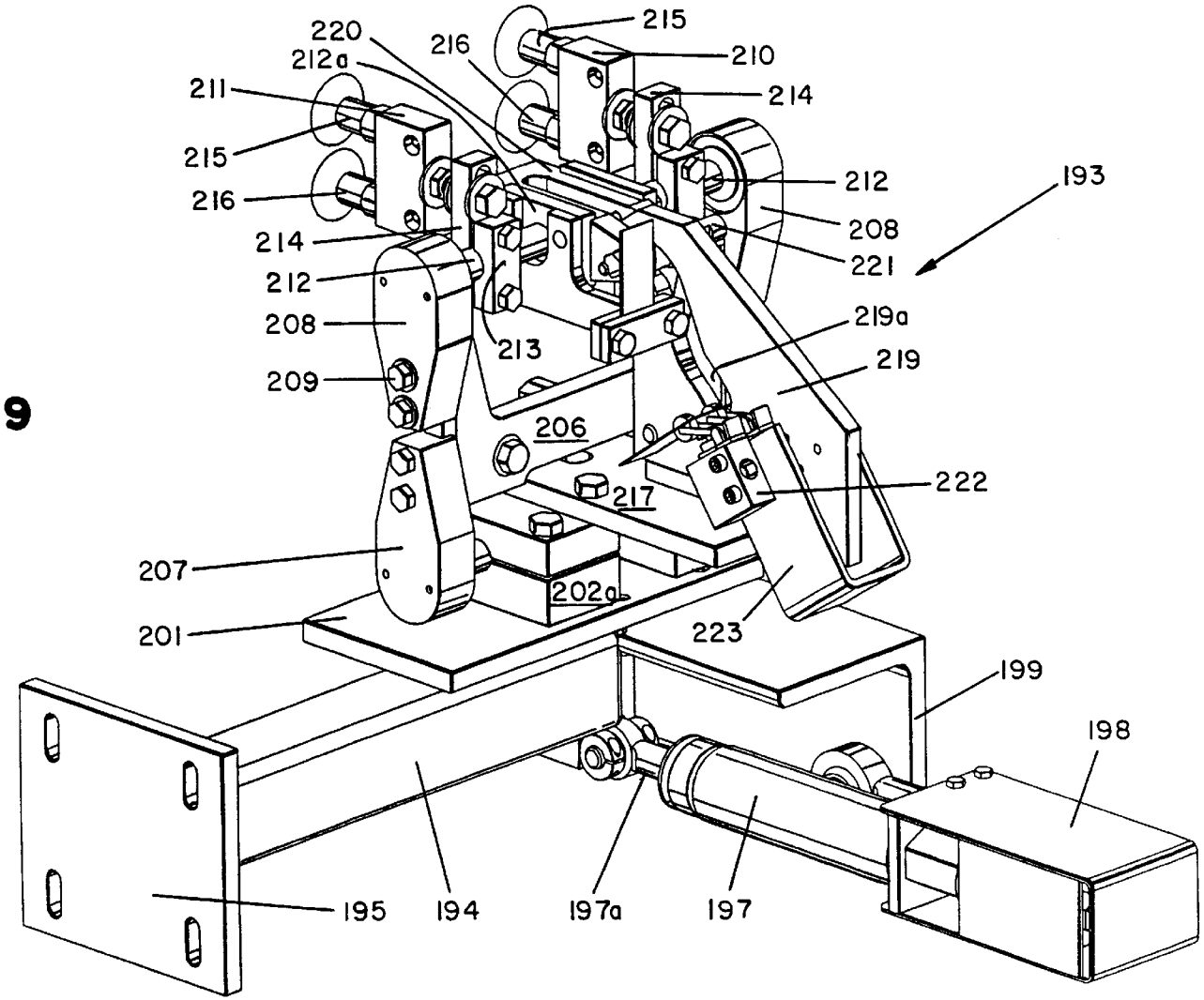
FIG. 9 is a perspective view of the dual vacuum cups, shown in FIG. 1.

A cantilevered output conveyor, generally designated at 172 is shown in a perspective view, as viewed from underneath, in FIG. 8. An exploded view, as viewed from the top, is shown in FIG. 2. As will be described, the output conveyor 172 is cantilevered from the support side of the dispenser 10 and extends toward the operating side of the dispenser 10. A connecting plate 173 has apertures 173*a* for connection, by suitable means such as bolts, to the angled support 147. Welded to the connecting plate 173 is a stop member 174 which is at the bottom of the output conveyor 172. A cylindrical support rod 175 has its first end 175*a* welded to the connecting plate 173. A generally H-shaped connector bracket 176 is rotatably mounted on the rod 175. The bracket 176 has two side members 176*a* and 176*b* connected by connecting member 176*c*. At the ends of each side 176*a* and 176*b* are two circular collars 176*d* and 176*e*. The connector bracket 176 is able to rotate about the rod 175. Welded to the bottom of the sides 176*a* and 176*b* is a bar 177. The bar rests on a plurality of bumpers 178 which are fastened to the stop member 174. The stop member 174 limits the downward rotation of the H-connector bracket 176. A drive pulley 179 is mounted on a drive shaft 180 that extends on both sides of the pulley 179. One end of the shaft 180 is rotatably mounted in the circular collar 176*e*. The other end of the drive shaft 180 is operatively connected to the drive shaft 181 of the output conveyor 172. A housing 182 is positioned over the pulley 179 and acts as a guard. A plurality of O-rings 183 are positioned around the drive shaft 182 and a shaft 184. Similarly, O-rings 185 are positioned around drive shaft 181 and shaft 186. The O-rings 183 and 185 are carried in grooves formed within the shafts 181, 184 and 186. End caps 187 and 188 each have three bearings (not shown) positioned inside of them. The bearings are for mounting the shafts 181, 184 and 186. The end caps 187 and 188 are similar and only one will be described in detail. The end cap 187 has a first housing 187*a* which is connected by an intermediate bar 187*b* to the second housing 187*c*. The two bearings for shaft 181 and 184 are in the housing 187*a* and the bearing for shaft 186 is in housing 187*c*. The housings 187*a* and 187*c* and bar 187*b* form a solid end cap for the shafts. The end cap 187 has a flange 187*d* which extends downward and is captured between a plate 189 (which is welded to the bar 177) and a second plate 189*a* by means of bolts. A handle 190 is welded to the plate 189*a*. The drive pulley 179 is connected by a drive belt 191 to a pulley 192. The pulley 192 is mounted on the jack shaft 165. The output conveyor 172 is able to be rotated, as viewed in FIG. 2, to rotate about the shaft 181. This allows the shaft 186 to move upward as the handle 190 is moved upward. The shaft 184 necessarily rotates downward. As will be described more fully hereafter, this rotation allows for access to the location where the bacon is placed on the bacon board.

A dispensing mechanism, generally designated as 193, is best seen in FIGS. 2, 9, 11 and 12. The dispensing mechanism 193 is for taking boards 300 from the board magazine and placing them into the feeding mechanism 146 for subsequent placement under drafts of bacon. The sequential schematic view of this operation is shown in FIG. 10 where the boards 300 are being shown taken from the board magazine and being placed between the rollers 154 and 156 of the feeding mechanism 146.

The dispensing mechanism 193 is supported by a support bar 194. The support bar 194 is welded to a plate 195 which is in turn bolted to a corresponding plate 196, which is in turn welded to the angled support 147. It can therefore be seen that the support 194 provides cantilevered support for the dispensing mechanism 193. A pneumatic cylinder 197, having an extendable arm 197*a*, is mounted to an L-shaped bracket 199 which is in turn secured to the support 194 by suitable means such as welding. A guard 198 is fastened to the cylinder 197.

A mounting plate 201 is operatively connected to the support bar 194 by suitable means such as welding. Two block assemblies 202 are used to pivotally mount vacuum assemblies 210 and 211. The vacuum assemblies 210 and 211 are symmetrically mounted and accordingly only one will be described in detail, it being recognized that the other is similarly mounted. The block assembly 202 has a lower section 202*a* that is suitably connected to the mounting plate 201 by suitable means such as welding. An upper section 202*b* is secured to the lower section 202*a* by a bolt 203. The lower section 202*a* and upper section 202*b* each have half of a cylindrical bore formed therein and together form a cylindrical bore for the pivotal mounting of shaft 204.

The extension arm 197*a* is connected to an L-bracket 205 having a lower portion 205*a* and a generally vertical upright section 205*b*. A generally rectangular block (not shown as it is hidden from view by blocks 202) is welded to the upright section 205*b*. The block has a bore and the shaft 204 is positioned inside of the bore of the block as well as the block assemblies 202. At the top of the upright section 205*b* is welded a cross bracket 206. The cross bracket 206 is also utilized for mounting bearing houses 207 and 208. The houses 207 and 208 are secured to the bracket 206 by bolts 209. The shaft 204 is mounted for rotational movement in the houses 207, blocks 202 and through the block of upright 205*b*. Therefore, in viewing FIG. 12, as the arm 197*a* is extended to the right, the upright 205*b* pivots counterclockwise around the shaft 204 and the bracket 206 moves to the left as it pivots around shaft 204, carrying with it the houses 207 and 208.

A shaft 212 is rotatably mounted inside of the bearing house 208. The shaft 212 is captured between two blocks 213 and 214 which each have half of a cylindrical bore and together form a full cylindrical bore for the shaft 212. The vacuum assemblies 210 and 211 are bolted to the blocks 214. Each vacuum assembly 210 and 211 has an upper suction cup 215 and a lower suction cup 216.

A cam base 217 is secured to the block assemblies 202 by bolts 218. In viewing FIG. 12, the portion of the cam base 217 to the right has a slot in which the upright 205*b* is positioned. The cam 219 has a cam track 219*a* formed therein. Each of the shafts 212 are operatively connected to a base 212*a* which is in turn secured to a yoke 220. The yoke 220 has a slot formed therein.

A cam follower 221 is inserted in bores formed on the split side of the yoke 220 and is therefore positioned in the yoke 220 and carried by the yoke 220, but is also positioned inside of the cam track 219*a*.

Air control valves are mounted on a bracket 223 which is carried by the yoke 219. The air control valves 222 control flow of a vacuum to the vacuum cups 215 and 216 by suitable hoses. A separate control is provided, but not shown, for controlling the air control valves 222, as is well known in the art.

In operation, the multi-position bacon board magazine is moved into the correct position depending upon the size of the bacon boards 300 to be dispensed. After one of the three preset heights are selected, the pusher member 284 is retracted by manually releasing the pressure on the cylinder 87. Then, a pneumatic valve (not shown) is activated to cause the pusher member 284 to apply pressure to the bacon boards 300. While not shown, it is understood that the pneumatic valve would be positioned between the source of pressurized air 97 and the regulators 94*b* through 96*b*. The infeed conveyor 26 and output conveyor 172 are run continuously by the drive assembly 23. Drafts of shingled strips of bacon 400 are supplied to the input conveyor 26 by means well known in the art. Depending upon the size of the bacon board 300 to be dispensed, either the upper suction cups 215 are activated and/or the lower suction cups 216 are activated. The pusher member 284 pushes the boards 300 up against the suction cups 215 and 216. There are two sensors, such as photo eye detectors, which are located in the dispensing mechanism 193. If no board 300 is detected as being in the dispensing mechanism 193, the vacuum cups 215 or 216 pull a board from the magazine and transfer it between the pinch rollers 155*a* and 156. The pinch rollers are driven by the clutch/brake 166 and the rollers are rotated until the board 300 is in the position "B" as shown in FIG. 10. The board is held stationary at this position until a draft of bacon is detected. The detector (not shown) activates a timer. After the timer times out the brake/clutch mechanism is activated thereby completing dispensing the board 300 as the draft of bacon 400 is going over the top of the board 300.

The sequencing of the dispensing mechanism 193 is shown in FIG. 10. There, in the first position shown, the suction cups are adjacent the board 300. The cylinder 197 is then actuated thereby causing the cam follower 221 to move in the cam track 219*a*. This causes the board 300 to move through the positions as shown in the dotted line in FIG. 10. The board is placed in position between the pinch rollers which then move the board 300 to position "B" where it is held in position until it is needed to be dispensed under the next draft of bacon 400. When the trailing edge of the board being dispensed passes a sensor, the cycle is repeated and the next board 300 is dispensed from the board magazine. The combination of the pivoting movement of the dispensing mechanism and the movement in the cam track provide a relatively horizontal removal of the boards from the stack of boards and then a movement up into the nip point between the rollers of the feeding mechanism.

By having the board magazine 43 positioned directly under the conveyor 26, a faster operation is possible as the boards 300 are more readily in position for dispensing. Further, it provides for accurate board placement as well as a large board storage capacity. Also, the three-position board magazine provides for quick change over between any of three board sizes with no time necessary for mechanics to change over between board sizes. Further, since the pressure or pushing force by the cylinder 87 decreases as boards are dispensed, the automatic decreasing of pressure allows for consistent board dispensing from a large horizontal magazine. The upper and lower suction cups 215 and 216 allow for either or both sets of vacuum cups to be run, depending upon the type of board to be dispensed. This again requires no set-up to change, simply a change of the valve 222 will accomplish this and no mechanic set-up time is required.

The cantilevered design of many of the components results in a very open and easy-to-clean design. Also, the dual flip open conveyors at the point of board dispensing helps gain access for any possible jams as well as for ease of sanitation.

Figure 13:
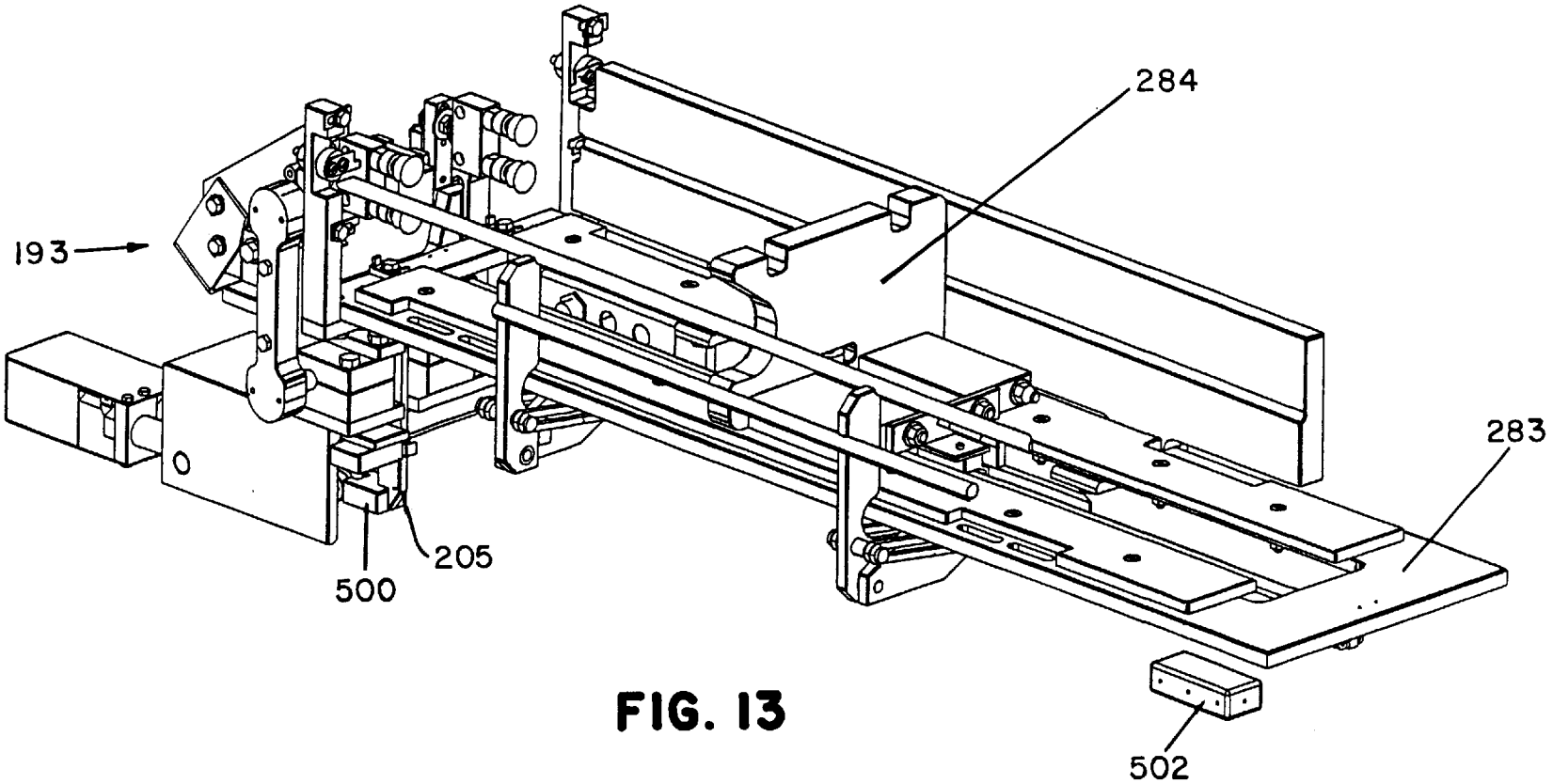
FIG. 13 is a second embodiment of a system to provide pressure to the cylinder of the board magazine.
Figure 14:
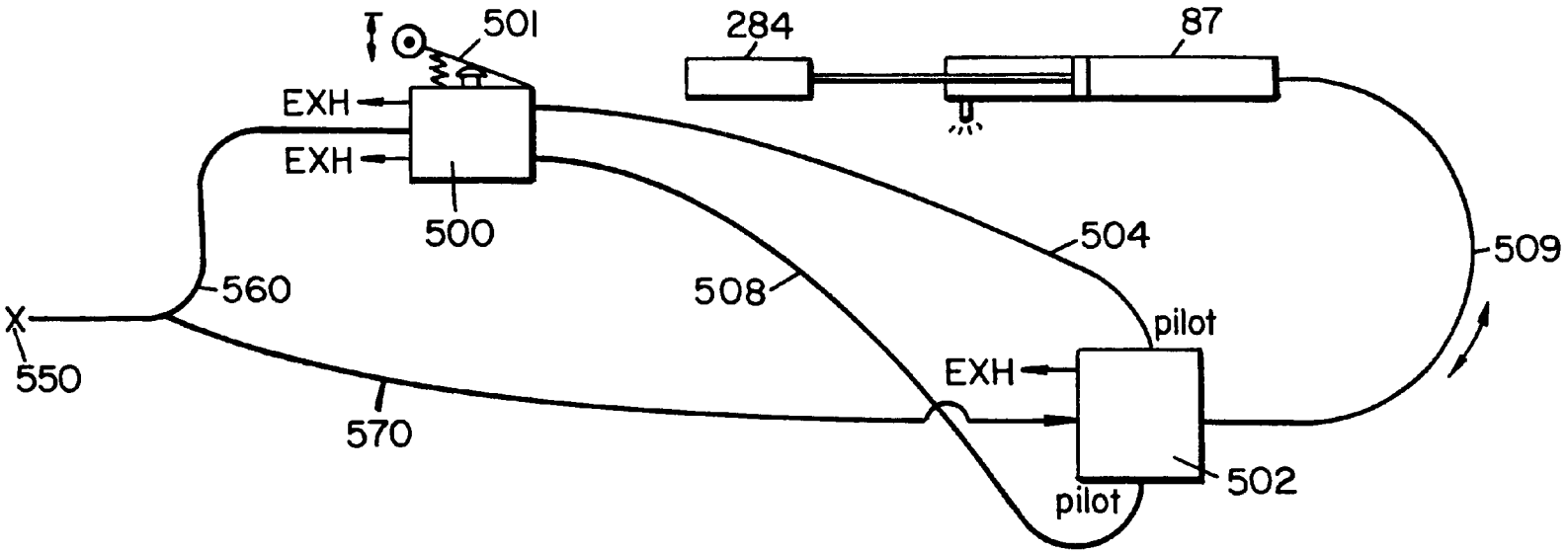
FIG. 14 is a schematic of the pressure system of FIG. 12.

A second embodiment of a pressure system to provide pressure to the cylinder 87 is shown in FIGS. 13 and 14. FIG. 14 represents a schematic of the pressure system. The second embodiment of the pressure system utilizes a single source of pressurized air 550 and a single valve 502 that is controlled by a switching valve 500, as opposed to the three regulators and cam followers used with respect to the first embodiment. A switching valve 500, having a cam follower 501, is mounted on the dispensing mechanism 193 such that the L-bracket 205 actuates the cam follower 501 on the valve 500. A valve 502 is mounted on the underneath side of the base plate 283 by suitable means such as bolts (not shown). The valve 502 is shown exploded away for clarity purposes. Each valve 500 and 502 have suitable exhaust ports for venting air to relieve pressure. As shown in FIG. 14, pressurized air from a suitable source 550 is provided to the valve 500 and valve 502 through lines 560 and 570, respectively. The cam follower 501, which is activated by the rotation of the L-bracket 205, causes the air to be supplied via connecting line 504 to a pilot on valve 502. A second connecting line 508 connects another pilot of the valve 502 to the valve 500. When the pressurized air from the switching valve 500 provides air to the valve 502, pressurized air flows via line 509 to the cylinder 87. This results in the pushing member 284 pushing on the boards towards the pick-off point. When the L-bracket 205 pivots back and the cam follower is released, pressure in the rodless cylinder 87 goes to zero. This occurs at the same time as the suction cups are pulling a board from the magazine. Therefore, with no force being exerted by the rodless cylinder 87, it is easier to pull a board out of the magazine. The remainder of the board magazine shown in FIG. 13 is the same as that previously described.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus for depositing predetermined quantities of sliced bacon in shingled condition on bacon boards, comprising:

(a) a frame having an input end, output end, support side and operating side;

(b) a bacon infeed conveyor operatively connected to the frame;

(c) a cantilevered output conveyor operatively connected to the support side and extending to the operating side;

(d) a dispenser mechanism operatively connected to the frame, the dispenser mechanism comprising:

(i) a first vacuum member for grasping a bacon board from the bacon board magazine, the first vacuum member operatively connected to the dispenser mechanism for movement between a first grasping position and second releasing position;

(ii) a second vacuum member for grasping a bacon board from the bacon board magazine, the second vacuum member operatively connected to the dispenser mechanism for movement between the first and second positions, the second vacuum member spaced from the first vacuum member;

(iii) a valve to selectively supply a vacuum to the first and second vacuum members, wherein bacon boards of different configurations may easily be dispensed;

(e) a multi-positioned bacon board magazine, the magazine comprising:

(i) a generally vertical bearing member;

(ii) a first frame mounted for vertical movement on the bearing member, the frame having a carrying surface for holding the bacon boards;

(iii) a lift operatively connected to the first frame for moving the first frame vertically;

(iv) a cradle operatively connected to the bearing member, the cradle having a plurality of stops at different vertical heights;

(v) the cradle slidable laterally to position a selected stop under the frame, wherein the frame is lowered to contact the selected stop, thereby positioning the frame; and (f) a cantilevered feeding mechanism operatively connected to the support side and extending to the operating side, the feeding mechanism for taking a bacon board dispensed by the dispenser mechanism and placing the bacon board under the sliced bacon, wherein the operating side is open thereby easing bacon board loading, cleaning and maintaining the apparatus.

2. The apparatus of claim 1, further comprising a pushing member operatively connected to the board magazine and a pneumatic cylinder for providing a force to boards positioned on the magazine.

3. The apparatus of claim 2, further comprising:

(a) a means for applying varying pressure to the pushing member;

(b) a means for sensing an amount of bacon boards on the support surface and lowering pressure applied to the pushing member as the amount of bacon boards decrease;

(c) the infeed conveyor cantilevered at the output end of the frame; and (d) the magazine is positioned under the infeed conveyor.

4. The apparatus of claim 2, further comprising:

(a) a switch valve activated by the dispensing mechanism;

(b) a second valve operatively connected to and controlled by the switch valve, the second valve operatively connected to the cylinder for providing a force to the pushing member; and (c) a source of pressurized air operatively connected to the switch valve, wherein pressure to the pushing member is released as a board is dispensed and activated after the board is dispensed to push remaining boards forward on the magazine.

* * * * *